United States Patent [19]

Oakes

[11] 4,370,256

[45] Jan. 25, 1983

[54] CORROSION INHIBITOR FOR ALUMINUM IN AQUEOUS ACIDS

[75] Inventor: Billy D. Oakes, Lake Jackson, Tex.

[73] Assignee: The Dow Chemical Company, Midland, Mich.

[21] Appl. No.: 133,214

[22] Filed: Mar. 24, 1980

Related U.S. Application Data

[63] Continuation-in-part of Ser. No. 760,043, Jan. 17, 1977, abandoned.

[51] Int. Cl.[3] ..... C23F 11/04; C23G 1/06

[52] U.S. Cl. ..... 252/391; 252/148; 252/151; 252/395

[58] Field of Search ..... 252/148, 149, 151, 391, 252/395, 8.55 B; 134/3, 41

[56] References Cited

U.S. PATENT DOCUMENTS

| | | | |
|---|---|---|---|
| 1,719,168 | 7/1929 | Chamberlain | 252/148 |
| 2,606,873 | 8/1952 | Cardwell et al. | 252/148 |
| 2,829,114 | 4/1958 | Hervert | 252/395 |
| 2,956,956 | 10/1960 | Strauss et al. | 252/149 |
| 3,077,454 | 2/1963 | Monroe et al. | 252/148 |
| 3,107,221 | 10/1963 | Harrison et al. | 252/148 |
| 3,135,632 | 6/1964 | Lucas et al. | 252/148 X |
| 3,415,748 | 12/1968 | Kovalski | 252/149 X |
| 3,481,882 | 12/1969 | Streicher | 252/149 |
| 3,793,221 | 2/1974 | Otrhalek et al. | 134/3 X |
| 3,802,890 | 4/1974 | Keeney | 252/148 X |

*Primary Examiner*—P. E. Willis, Jr.

[57] ABSTRACT

The corrosion of aluminum in the presence of aqueous mineral acid solutions containing conventional nitrogen base ferrous metal corrosion inhibitors is markedly reduced by incorporating an alkyl, aryl or alkylaryl sulfonate or sulfate surface active agent as an additional corrosion inhibiting agent.

5 Claims, No Drawings

CORROSION INHIBITOR FOR ALUMINUM IN AQUEOUS ACIDS

CROSS REFERENCE TO RELATED APPLICATION

This application is a continuation-in-part of my earlier filed application Ser. No. 760,043 filed Jan. 17, 1977 entitled "Corrosion Inhibitor for Aluminum in Aqueous Acids", now abandoned.

BACKGROUND OF THE INVENTION

The metal cleaning industry has for years used aqueous acids to remove scale and surface dirt from metals. These aqueous acid solutions are used in such diverse applications as boiler cleaning, radiator cleaning and pickling. The metals cleaned are similarly diverse, aluminum, brass, copper, solder, steel and cast iron. Often two or more of these metals are cleaned in the same system. It is also the habit of the industry to inhibit these acid solutions to prevent attack on the metals being cleaned. Inhibitors known to reduce attack by these acid solutions on brass, copper, solder steel and cast iron are also known to be poor in protecting aluminum. Inhibitors known to be useful to prevent attack on aluminum are generally poor in protecting the other metals and, in addition, are for the most part more toxic and thus less desirable to employ.

Many patents and literature have been published describing combinations or reaction products which are useful to prevent corrosion of ferrous or non-ferrous metals in contact with acid media, although aluminum is usually a special problem. Most of these compositions, as well as the more common industrial compositions, use surface active agents to improve dispersion or compatibility of the active inhibitors in the aqueous acid media and/or the dispersion of the metal salts, resulting from the reaction of the acid with the metal oxides being removed, and the other grime, greases, oils, etc., which the cleaning solution removes. Examples of corrosion inhibitors which incorporate surfactants can be found in Oakes, U.S. Pat. No. 3,017,355, Harrison, et al., U.S. Pat. No. 3,107,221 and Keeney, U.S. Pat. No. 3,802,890 to name but a few. Kaneko, et al., U.S. Pat. No. 3,676,354 discloses a synergistic increase in corrosion inhibition of acid solutions on ferrous metals when a nonionic surfactant is used in combination with an alkanolamine as the principal corrosion inhibitor.

It would be advantageous to provide an inhibitor composition suitable for use in the presence of aqueous acids in conjunction with the several metals including aluminum. It would also be advantageous to provide an inhibitor composition of no more toxicity than those nitrogen containing compounds now in use.

SUMMARY OF THE INVENTION

It has now been discovered that a synergistic reduction in the corrosion of aluminum in acid media is obtained when various known nitrogen containing or dextrin corrosion inhibitors are employed in combination with certain anionic surfactants. Although the surfactants of the present invention show some corrosion inhibiting properties when used singly, a highly unexpected increase in inhibition occurs when the surfactant and the known inhibitor are employed in concert. Accordingly, one aspect of the invention is a corrosion inhibiting composition consisting of: (1) a suitable corrosion inhibitor selected from the group consisting of:

A. Heterocyclic, nitrogen-containing aryl, alkyl, and alkylaryl monocyclic and polycyclic compounds, with from 5 to about 14 carbon atoms which may contain one or more alkanolamine moieties;

B. Alkanolamines with from 2 to about 14 carbon atoms;

C. Thiourea and thioureas substituted with no more than about 12 carbon atoms;

D. Dextrin;

E. A mixture of the foregoing A through D; (2) in admixture with an anionic sulfate or sulfonate surfactant selected from the group consisting of alkyl, aryl, and alkylaryl sulfates and sulfonates, and their alkali metal salts. The components are selected such that, and present in concentrations such that, the composition is effective to inhibit corrosion in acid media of aluminum and aluminum alloys to an extent superior to the inhibition obtained when either component is used alone at a similar concentration. Another aspect of this invention is an acid cleaning composition comprising from about 1 to about 20 percent of a mineral acid, water, the corrosion inhibiting composition herein described, and, optionally, a composition to inhibit corrosion of metals other than aluminum.

FURTHER DESCRIPTION OF THE INVENTION

The present invention is concerned primarily with the discovery that the addition of certain anionic surfactants to various known corrosion inhibitors synergistically increases the corrosion inhibiting effect in acid media, compared to the use of either component alone. The present compositions are effective in acids such as hydrochloric, sulfuric, phosphoric, sulfamic, and the like. However, the synergism is most readily apparent when hydrochloric acid is the corrodent, since it is the most corrosive. The concentration of acid in which the present invention is effective to inhibit corrosion varies with the particular acid involved. Generally, this concentration of acid ranges from minute amounts to about 5 percent, although in hydrochloric acid, the maximum concentration of acid is about 3 percent. It is found that some of the various known corrosion inhibitors, when used in the present invention, may be employed at significantly lower concentrations than when used alone. Other compounds, which by themselves are not particularly effective corrosion inhibitors, are rendered useful by the present invention.

The corrosion inhibiting composition of the present invention comprises two parts, an anionic surfactant, and a known corrosion inhibitor. While the precise amounts of each will vary with the particular components involved, the surfactant generally comprises from about 90 to about 25 percent of the inhibitor composition, and usually from about 25 to about 75 percent. The known corrosion inhibitor makes up the rest of the composition. The relative amounts of each should be selected such that a significant increase in corrosion inhibition is obtained, compared to the case where either component is used singly at that concentration. Generally, this increase in corrosion inhibition is such that the amount of corrosion may oftentimes be reduced by about half, and in the preferred embodiments the improvement is even more dramatic. Under the conditions of the Examples and comparison runs, a composition which limits the aluminum weight loss to about 20 mg or less is preferred.

The known corrosion inhibitor of the composition may be one of a wide variety of amines, a thiourea, or dextrin. It is also possible to use a mixture of these inhibitors.

AMINES

The amines within the scope of this invention may be described as heterocyclic, nitrogen-containing aryl, alkyl, and alkylaryl monocyclic and polycyclic compounds, with from 5 to about 14 carbon atoms, including alkanolamine substituted derivatives or alkanolamines, with from 2 to about 14 carbon atoms, or a mixture of these. It is preferred to use acridine, benzotriazole, ethanolamine, hexamethylenetetraamine, morpholine, pyrazine, pyrrole, and forms of these which are substituted with aliphatic moieties so long as the molecule contains a total of no more than about 14 carbon atoms. It is also preferred to use a complex amine made according to the method of U.S. Pat. No. 3,077,454, which comprises allowing an amine to react with formaldehyde, acetophenone, an organic acid, and hydrochloric acid. In practice it is not advisable to use an amine which contains more than about 14 carbon atoms, since it becomes difficult to dissolve in the aqueous acid systems, thus exhibiting reduced corrosion inhibiting effect.

It is known that corrosion inhibition is synergistically increased when an acetylenic alcohol is employed with an amine. Thus, it is oftentimes advantageous to include with the composition of the present invention an acetylenic alcohol. Further, surfactants, such as nonionic surfactants, may be included with the composition to increase the dispersion of the corrosion inhibiting composition.

THIOUREAS

Thiourea, thioureas substituted with no more than about 12 carbon atoms, dextrin and forms of dextrin substituted with no more than about 6 to 8 carbon atoms, may also be used as the corrosion inhibitor in the present composition. Particularly, thiourea, para-tolyl thiourea, may be employed.

DEXTRIN

Dextrin has been used effectively as a corrosion inhibitor for ferrous metals and may likewise be employed in accordance with the present invention with good results as the principal coinhibitor of composition hereunder.

Inorganic corrosion inhibitors such as sodium chromate, ammonium chromate, and sodium arsenite may also be used, but since these substances are quite toxic they are not particularly desirable.

The sulfate and sulfonate anionic surfactants which exhibit synergism when employed with the above inhibitors include alkyl, aryl, and alkylaryl sulfates and sulfonates, and their alkali metal salts. Particularly, modified sodium alkylaryl sulfonate, sodium alkylaryl sulfonate, sodium lauryl sulfate, sodium dodecylbenzene sulfonate, sodium salt of dodecylated sulfonated phenyl ether, alkylalkylolamine sulfate, mixed alkylalkylolamine long chain alcohol sulfates, sodium hydrocarbon sulfonate, fortified complex sulfonate, and sodium 2-propene-1-sulfonate may be used. Particularly effective are the sodium alkyaryl sulfonate such as sodium dodecylbenzene sulfonate, sodium salt of dodecylated sulfonated phenyl ether, and the sodium hydrocarbon sulfonate.

Nonionic and cationic surfactants reduce the surface tension just as well as do the anionics, but do not exhibit the synergism.

It is common to use an aqueous acid solution to clean radiators, boilers, and the like. Generally, one or more corrosion inhibitors are included in the acid solution to prevent the acid from attacking and corroding the metal surfaces. Accordingly, an acid cleaning composition may be made, containing water, acid, a composition to inhibit corrosion of metals other than aluminum, and the hereinabove described corrosion inhibitor composition. Many compositions are known which inhibit the corrosion of metals other than aluminum. See, e.g., Oakes U.S. Pat. No. 3,017,355 and Harrison et al, U.S. Pat. No. 3,107,221. In some cases, the corrosion inhibitor used in the present invention is effective to inhibit corrosion of other metals. This is true with, for example, the inhibitor made according to Monroe, et al., U.S. Pat. No. 3,077,454. In such cases, the additional inhibitor need not be added. The present invention reduces the corrosion caused by the acids commonly used in acid cleaning formulation, the so-called mineral acids, such as hydrochloric, sulfuric, phosphoric, and sulfamic acids. Generally, cleaning compositions contain from about 1 to about 5 percent acid by weight, although lesser and slightly greater amounts are effective. It is to be understood that when hydrochloric acid is the active agent, most inhibitor compositions can be dissolved in the system in sufficient amounts to inhibit effectively the corrosion occasioned by greater than about a 3 weight percent concentration of the acid. Thus, in use, acid cleaning compositions employing hydrochloric acid should be made up or diluted, as is the practice with other inhibitors, to contain not more than about 3 percent acid when the corrosion inhibitor of the present invention is to be employed. The present corrosion inhibiting composition is effectively dissolved or dispersed in other acids which are at concentrations as high as 5 weight percent. In commercial practice it is preferred to make up the composition to contain about 20 weight percent acid, and then dilute with water to obtain the desired cleaning concentration.

When the acid cleaning composition is made up (or diluted) to contain 1 weight percent acid, each of the other components should be present in an amount of from about 0.02 to about 1 weight percent within the restrictions noted above as to the relative proportions or surfactant and inhibitor. As the concentration of acid in the cleaning composition is increased, the amounts of inhibitor and surfactant necessary to provide effective corrosion inhibition is correspondingly increased. Thus, at a 20 percent concentration of acid, the inhibitor and surfactant should each be present at a concentration of about not less than 0.4 weight percent each to about a maximum of 20 weight percent each, so that when the solution is diluted to contain one weight percent acid, the concentration of each of inhibitor and surfactant will be at least about 0.01 to about 1 weight percent. Preferably, a 20 percent solution of acid contains from about 1 to about 10 weight percent of each of the inhibitor and surfactant. For example, a particular preferred embodiment comprises 20 percent hydrochloric acid, 1 percent acridine and 2 percent of the sodium salt of dodecylated sulfonated phenyl ether. When diluted to contain 1 percent hydrochloric acid, it will have 0.05 percent acridine and 0.1 percent surfactant. Another embodiment would contain 20 percent hydrochloric acid, 6 percent of a corrosion inhibitor formulated according to U.S. Pat. No. 3,077,454, and 2 percent sodium hydrocarbon sulfonate.

EXAMPLES

Candidate inhibitors of aluminum corrosion were screened for use by suspending a coupon of cast Alluminum Alloy 319 (6.3 percent Si, 3.5 percent Cu), specified by ASTM Method D-1384 and typical of those present in various engines, in 500 mls of 1 percent HCl at 170±2° F. for 30 minutes while continuously stirring. The coupons are a standard 1 inch×2 inch×⅛ inch in size, with a hole in the center for suspending them, and the weight loss in milligrams after a 30 minute exposure is a measure of the effectiveness of the inhibitor being tested; the lower the loss in weight, the more effective the corrosion inhibitor. It will be readily apparent to those skilled in the art that temperature and other variables of the following examples may readily be changed. However, it is felt that the parameters of the following examples typify those conditions found in actual use. In each instance where it was used in the following examples, the corrosion inhibitor of U.S. Pat. No. 3,077,454 was formulated as taught therein to contain a nonionic wetting agent and an acetylenic alcohol. Amounts of inhibitor and surfactant are given in weight percent, and the aluminum weight loss in mg. An asterisk by a run number indicates that it is a comparison run not illustrative of the present invention.

Table I illustrates the invention by presenting aluminum weight losses in 1 percent HCl with no inhibitors present, with the ingredients individually present and the dramatic drop that occurs when both of the ingredients of the invention are present.

Table II is illustrative of some of the variations of amounts of inhibitor and surfactant which exhibit the synergism. It also illustrates the significantly lower concentrations of inhibitor which may be used. Acridine was the corrosion inhibitor in each of the runs in Table II.

Table III presents the results of similar tests in other acids and other concentrations of acid.

Table IV contains the results of runs which show that the surfactants considered to be outside the scope of the present invention do not exhibit the synergistic effect.

The following abbreviations are used in Tables I-IV:

A—sodium alkylaryl sulfonate (Alkanol® WXN)[1]
B—sodium alkylarylsulfonate
C—sodium laurylsulfate
D—sodium dodecylbenzene sulfonate
E—sodium salt of dodecylated sulfonated phenyl ether
F—alkylalkylolamine sulfate
G—mixed alkylalkylolamine long chain alcohol sulfates (Duponol® QST)[1]
H—sodium hydrocarbon sulfonate
I—complex sulfonate (Alkanol® TD)[1]
J—sodium 2-propene-1-sulfonate
K—sodium laurylsulfate, U.S.P. grade
L—Doecyltrimethylammonium chloride (a cationic surfactant)
M—Nonylphenol condensed with 15 moles ethylene oxide (a nonionic surfactant)
N—sodium laurylsulfate, U.S.P. grade
HMTA—hexamethylenetetraamine

[1]. Manufactured by E. I. DuPont de Nemours.

TABLE I

| Run | Inhibitor | | Surfactant | | Aluminum Weight |
|---|---|---|---|---|---|
| No. | Type | Amount | Type | Amount | Loss |
| *1 | None | | None | | 509 |
| *2 | " | | A | .3 | 170.6 |
| *3 | " | | A | .1 | 324.2 |
| *4 | " | | C | .3 | 66.4 |
| *5 | " | | C | .1 | 97.3 |
| *6 | " | | E | .3 | 46.3 |
| *7 | " | | E | .1 | 200.7 |
| *8 | " | | D | .3 | 123.6 |
| *9 | " | | D | .1 | 247.3 |
| *10 | " | | B | .3 | 129.2 |
| *11 | " | | B | .1 | 219.3 |
| *12 | HMTA | .5 | None | | 120.5 |
| *13 | " | .3 | None | | 197.7 |
| 14 | " | .5 | A | .1 | 19.5 |
| 15 | " | .3 | A | .1 | 30.6 |
| 16 | " | .5 | C | .1 | 20.3 |
| 17 | " | .3 | C | .1 | 37.1 |
| 18 | " | .3 | E | .1 | 28.9 |
| 19 | " | .3 | D | .1 | 27.7 |
| 20 | " | .3 | B | .1 | 34.3 |
| 21 | " | .3 | K | .1 | 32.4 |
| 22 | " | .3 | F | .1 | 41.0 |
| 23 | " | .3 | N | .1 | 30.3 |
| 24 | " | .3 | G | .1 | 34.7 |
| 25 | " | .3 | H | .1 | 4.9 |
| 26 | " | .3 | B | .1 | 57.4 |
| 27 | " | .3 | I | .1 | 48.9 |
| *28 | U.S. Pat. No. 3,077,454 | .3 | None | | 88.0 |
| 29 | U.S. Pat. No. 3,077,454 | .3 | A | .1 | 46.1 |
| 30 | U.S. Pat. No. 3,077,454 | .3 | C | .1 | 43.4 |
| 31 | U.S. Pat. No. 3,077,454 | .3 | E | .1 | 16.7 |
| 32 | U.S. Pat. No. 3,077,454 | .3 | K | .1 | 29.7 |
| 33 | U.S. Pat. No. 3,077,454 | .3 | F | .1 | 41.4 |
| 34 | U.S. Pat. No. 3,077,454 | .3 | N | .1 | 33.5 |
| 35 | U.S. Pat. No. 3,077,454 | .3 | G | .1 | 46.8 |
| 36 | U.S. Pat. No. 3,077,454 | .3 | H | .1 | 5.9 |
| 37 | U.S. Pat. No. 3,077,454 | .3 | I | .1 | 15.6 |
| *38 | Thiourea | .3 | None | | 139.0 |
| 39 | " | .3 | A | .1 | 15.1 |
| 40 | " | .3 | C | .1 | 18.7 |
| 41 | " | .3 | E | .1 | 15.0 |
| *42 | Pyrazine | .3 | None | | 508.0 |
| 43 | " | .3 | A | .1 | 31.6 |
| 44 | " | .3 | E | .1 | 12.8 |
| *45 | N—Methylpyrrole | .3 | None | | 253.6 |
| 46 | " | .3 | A | .1 | 126.7 |
| 47 | " | .3 | E | .1 | 63.6 |
| 48 | " | .3 | H | .1 | 6.8 |
| *49 | Ethanolamine | .3 | None | | 336.0 |
| 50 | " | .3 | A | .1 | 128.5 |
| 51 | " | .3 | E | .1 | 75.1 |
| 52 | " | .3 | H | .1 | 7.5 |
| *53 | Morpholine | .3 | None | | 311.4 |
| 54 | " | .3 | A | .1 | 103.1 |
| 55 | " | .3 | E | .1 | 69.1 |
| *56 | Benzotriazole | .3 | None | | 137.0 |
| 57 | " | .3 | A | .1 | 19.0 |
| 58 | " | .3 | C | .1 | 26.3 |
| 59 | " | .3 | E | .1 | 5.5 |
| 60 | " | .3 | H | .1 | 3.5 |
| *61 | p-Tolylthiourea | .3 | None | | 103.6 |
| 62 | " | .3 | C | .1 | 9.6 |
| 63 | " | .3 | E | .1 | 4.7 |
| 64 | " | .3 | H | .1 | 2.0 |
| *65 | Dextrin | .3 | None | | 240.4 |
| 66 | " | .3 | A | .1 | 61.3 |

TABLE II

| Run No. | Inhibitor Amount | Surfactant Type | Surfactant Amount | Aluminum Weight Loss |
|---|---|---|---|---|
| *67 | .3 | None | | 18.8 |
| *68 | .1 | None | | 56.3 |
| *69 | .05 | None | | 90.0 |
| 70 | .05 | A | .1 | 5.1 |
| 71 | .05 | C | .1 | 4.6 |
| 72 | .05 | E | .1 | 5.3 |
| 73 | .05 | K | .1 | 7.7 |
| 74 | .05 | F | .1 | 7.1 |
| 75 | .05 | N | .1 | 11.6 |
| 76 | .05 | G | .1 | 11.9 |
| 77 | .05 | H | .1 | 2.1 |
| 78 | .05 | B | .1 | 2.6 |
| 79 | .05 | I | .1 | 12.8 |
| 80 | .05 | B | .05 | 5.0 |
| 81 | .05 | D | .05 | 5.7 |
| 82 | .05 | J | .05 | 16.0 |

TABLE III

| Run No. | Type | Acid Conc. | Inhibitor Amount | Surfactant Amount | Aluminum Weight Loss |
|---|---|---|---|---|---|
| *83 | HCl | 2% | 0 | 0 | 1639 |
| 84 | HCl | 2% | .05 | .1 | 23.3 |
| *85 | HCl | 3% | 0 | 0 | 3293 |
| 86 | HCl | 3% | .05 | .1 | 313.6 |
| 87 | HCl | 3% | .1 | .2 | 14.6 |
| *88 | $H_2SO_4$ | 1% | 0 | 0 | 26.4 |
| 89 | $H_2SO_4$ | 1% | .05 | .1 | 13.6 |
| *90 | $H_3PO_4$ | 1% | 0 | 0 | 32.0 |
| 91 | $H_3PO_4$ | 1% | .05 | .1 | 4.8 |
| *92 | Sulfamic | 1% | 0 | 0 | 13.6 |
| 93 | Sulfamic | 1% | .05 | .1 | 1.2 |
| *94 | $H_2SO_4$ | 5% | 0 | 0 | 50.0 |
| 95 | $H_2SO_4$ | 5% | .05 | .1 | 30.8 |
| *96 | $H_3PO_4$ | 5% | 0 | 0 | 127.2 |
| 97 | $H_3PO_4$ | 5% | .05 | .1 | 33.9 |
| *98 | Sulfamic | 5% | 0 | 0 | 24.2 |
| 99 | Sulfamic | 5% | .05 | .1 | 0.3 |

TABLE IV

| Run No. | Inhibitor Type | Inhibitor Amount | Surfactant Type | Surfactant Amount | Weight Loss |
|---|---|---|---|---|---|
| *100 | HMTA | .3 | None | | 197.7 |
| *101 | " | .3 | L | .1 | 100.8 |
| *102 | " | .3 | M | .1 | 92.3 |
| 103 | " | .3 | E | .1 | 28.9 |
| *104 | Acridine | .05 | None | | 90.0 |
| *105 | " | .05 | L | .1 | 103.8 |
| *106 | " | .05 | M | .1 | 170.8 |
| 107 | " | .05 | E | .1 | 5.3 |

I claim:

1. A corrosion inhibiting composition comprising benzotriazole and an anionic surfactant selected from the group consisting of alkali metal alkyl, aryl and alkylaryl sulfates and sulfonates; said surfactant being present in from about 25 to about 67 percent of said composition.

2. A corrosion inhibiting composition comprising hexamethylenetetraamine and an anionic surfactant selected from the group consisting of alkali metal alkyl, aryl and alkylaryl sulfates and sulfonates; said surfactant being present in from about 25 to about 67 percent of said composition.

3. A corrosion inhibiting composition comprising morpholine and an anionic surfactant selected from the group consisting of alkali metal alkyl, aryl and alkylaryl sulfates and sulfonates; said surfactant being present in from about 25 to about 67 percent of said composition.

4. A corrosion inhibiting composition comprising pyrazine and an anionic surfactant selected from the group consisting of alkali metal alkyl, aryl and alkylaryl sulfates and sulfonates; said surfactant being present in from about 25 to about 67 percent of said comparison.

5. A corrosion inhibiting composition comprising pyrrole and an anionic surfactant selected from the group consisting of alkali metal alkyl, aryl and alkylaryl sulfates and sulfonates; said surfactant being present in from about 25 to about 67 percent of said composition.

* * * * *

UNITED STATES PATENT AND TRADEMARK OFFICE

CERTIFICATE OF CORRECTION

PATENT NO. : 4,370,256

DATED : January 25, 1983

INVENTOR(S) : Billy D. Oakes

It is certified that error appears in the above—identified patent and that said Letters Patent is hereby corrected as shown below:

Col. 3, line 67; "alkyaryl" should read --alkylaryl--.

Col. 4, line 49; change "or" to --of--.

Col. 5, line 63; "Doecyltrimethylamminium" should read --Dodecyltrimethylammonium--.

Col. 8, line 35, Claim 4; "comparison" should read --composition--.

Signed and Sealed this

*Nineteenth* Day of *July 1983*

[SEAL]

*Attest:*

GERALD J. MOSSINGHOFF

*Attesting Officer*

*Commissioner of Patents and Trademarks*